US010531714B2

(12) United States Patent
Okamura

(10) Patent No.: US 10,531,714 B2
(45) Date of Patent: Jan. 14, 2020

(54) PERSONAL ORNAMENTS

(71) Applicant: HOUJIN CO., LTD., Tokyo (JP)

(72) Inventor: Kazuo Okamura, Tokyo (JP)

(73) Assignee: SUN CHALAINE CO., LTD., Tokyo (JP)

( * ) Notice: Subject to any disclaimer, the term of this patent is extended or adjusted under 35 U.S.C. 154(b) by 0 days.

(21) Appl. No.: 15/760,125

(22) PCT Filed: Sep. 14, 2016

(86) PCT No.: PCT/JP2016/077046
§ 371 (c)(1),
(2) Date: Mar. 14, 2018

(87) PCT Pub. No.: WO2017/047611
PCT Pub. Date: Mar. 23, 2017

(65) Prior Publication Data

US 2018/0255884 A1 Sep. 13, 2018

(30) Foreign Application Priority Data

Sep. 16, 2015 (JP) ..... 2015-182985

(51) Int. Cl.
*A44C 15/00* (2006.01)
*A44C 25/00* (2006.01)

(52) U.S. Cl.
CPC ..... *A44C 25/001* (2013.01); *A44C 15/005* (2013.01); *A44C 25/007* (2013.01)

(58) Field of Classification Search
CPC ..... A44C 5/00; A44C 5/0053; A44C 5/2071; A44C 13/00; A44C 25/00; A44C 25/001;
(Continued)

(56) References Cited

U.S. PATENT DOCUMENTS

2008/0256979 A1* 10/2008 Okamura ..... A44C 5/2071 63/3.1
2015/0189403 A1* 7/2015 Magi ..... H04Q 9/00 340/870.07
2015/0359301 A1* 12/2015 Lavorato ..... A44C 5/20 63/3.1

FOREIGN PATENT DOCUMENTS

JP 2001204522 A 7/2001
JP 2007044131 A 2/2007
(Continued)

*Primary Examiner* — Jack W Lavinder
(74) *Attorney, Agent, or Firm* — Blueshift IP, LLC; Robert Plotkin

(57) ABSTRACT

Provided is a jewelry piece that includes an ornament attachment member that is retained at a prescribed position in the longitudinal direction of an elongated body of the jewelry piece. The jewelry piece includes the elongated body that includes a tube formed by a flexible material, multiple magnet pieces that are inserted into the inside of the tube over the entire length of the tube other than both end sections of the tube, and caps that close both ends of the tube, and the ornament attachment member that the elongated body passes through, and that is retained due to the magnetic attraction force exerted by a magnetic substance at a prescribed position in the longitudinal direction of the elongated body. The ornament attachment member is formed by a core body made of a magnetic material, through which the elongated body passes, and by an ornament that is integrally formed with the core body so as to surround the core body.

1 Claim, 1 Drawing Sheet

(58) Field of Classification Search
CPC ... A44C 25/007; A44C 15/005; A44C 11/002; A44C 7/002; A44D 2203/00; Y10S 63/90; Y10T 24/32
See application file for complete search history.

(56) References Cited

FOREIGN PATENT DOCUMENTS

| | | | |
|---|---|---|---|
| JP | 2007135739 | A | 6/2007 |
| JP | 2011078524 | A | 4/2011 |

* cited by examiner

PERSONAL ORNAMENTS

TECHNICAL FIELD

The present invention relates to a jewelry piece, and more particularly, relates to a jewelry piece that allows an ornament attachment member to be retained at any longitudinal position of an elongated body of the jewelry piece.

BACKGROUND ART

Traditional jewelry related items such as a necklace that uses a pendant generally do not allow a pendant attachment part to freely move along the necklace. Also, the jewelry components of the traditional jewelry related items such as pendants, ornaments, and the like are generally not replaceable.

Jewelry pieces including necklaces are generally provided with clasps at each end of the elongated member of a jewelry piece. There are various types of the clasps that are applied to the jewelry piece, for example, (1) one end of the elongated member is provided with a retractable pin, and the other end thereof is provided with a ring, whereby the pin is engaged with the ring so that the one end of the elongated member is engaged with the other end thereof; and (2) one end of the elongated member is provided with a ring that can be opened and closed, and the other end thereof is inserted into the ring so that the elongated member can form a ring having any diameter, whereby the jewelry piece formed into a ring is put on a wearer.

Those clasps are generally made small so as not to affect the aesthetic value of the jewelry piece. However, people who are not skillful with their fingers such as elderly persons, or the persons who have poor eyesight feel difficult in dealing with such small clasps when they try to wear a jewelry piece or unclasp an engaged jewelry piece. In order to facilitate the easiness of wearing a jewelry piece, magnet materials have been used as a clasp means. For example, a string-shaped plastic magnet or rubber magnet has been produced by injection molding or extrusion molding using magnet powder that is mixed with a suitable material.

However, the clasp means using magnetic materials does not exert a strong magnetic attraction because the amount of the magnet materials contained in the clasp means is limited. Therefore, such clasp means fails to tightly join a jewelry piece, whereby if a strong force is applied to the jewelry piece in such a way that the clasp means is disjoined, the jewelry piece easily comes off from a wearer. Accordingly, such jewelry piece involves a risk that, for example, it is easily taken away forcibly from a wearer thereof.

If a metal magnet is used for the clasp means, the attraction force thereof is too strong to disjoin a jewelry piece, which causes inconvenience to the wearer of the jewelry piece.

PRIOR-ART DOCUMENTS

Patent Documents

[Patent Document 1] JP-A-2001-204522

SUMMARY OF THE INVENTION

Technical Problems

Disclosed is a jewelry piece that allows for easy attachment of an ornament to the jewelry piece, allows for easily relocating the position at which the ornament is attached to the jewelry piece, and allows for easily replacing the attached ornament to a new ornament. The jewelry piece of the present invention also includes an elongated body that allows for easy wearing and removal of the jewelry piece.

Solution to the Problem

In a preferred embodiment of the present invention, a jewelry piece includes (1) an elongated body including a tube that is formed by a flexible material, multiple magnet pieces that are inserted into the inside of the tube over the entire length of the tube other than both end sections of the tube 3, and caps that close both ends of the tube; and (2) an ornament attachment member that the elongated body passes through, and that is retained due to the magnetic attraction force exerted by a magnetic substance at a prescribed position in the longitudinal direction of the elongated body.

In a preferred embodiment of the jewelry piece, the ornament attachment member is formed by a core body made of a magnetic material, through which the elongated body passes, and an ornament that is integrally formed with the core body so as to surround the core body.

In a preferred embodiment of the jewelry piece, the ornament attachment member is made by forming a magnetic material in a ring shape through which the elongated body passes.

In a preferred embodiment of the jewelry piece, each of the magnet pieces is formed so as to be rotatable inside the tube.

In a preferred embodiment of the jewelry piece, the tube includes an inner tube into which the magnet pieces are inserted, and an outer tube that covers the inner tube, and wherein the caps are provided to the inner tube and the outer tube at the both ends thereof respectively.

Advantageous Effects to the Invention

The jewelry piece according to the present invention allows an ornament attachment member to be retained at any longitudinal position of an elongated body of the jewelry piece, and allows for easily replacing the attached ornament to a new ornament. Also, the jewelry piece includes an elongated body that allows for easy wearing and removal of the jewelry piece.

DESCRIPTION OF THE EMBODIMENT

Figure 1:
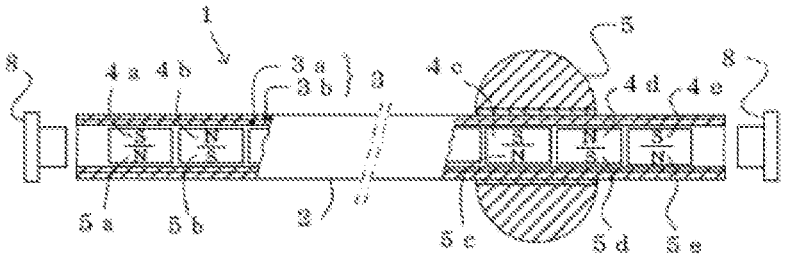
FIG. 1 is a schematic view of the present invention showing a cross section of a jewelry piece in which an ornament attachment member is provided to an elongated body, and caps are attached to each end of the elongated body.

Referring to FIGS. 1-4, an embodiment of the present invention will be described. A jewelry piece 1 of the present invention includes (1) an elongated body 2 that includes a tube 3 that is formed by a flexible material, multiple magnet pieces 4 that are inserted into the inside of the tube 3 over the entire length of the tube 3 other than both end sections of the tube 3, and caps 8 that close both ends of the tube 3, and (2) an ornament attachment member 5 that the elongated body 2 passes through, and that is retained due to the magnetic attraction force exerted by a magnetic substance at a prescribed position in the longitudinal direction of the elongated body 2.

FIG. 1 is a cross section of the jewelry piece 1 that includes the elongated body 2 and the caps 8, showing the configuration of the magnet pieces 4 inserted into the elongated body 2.

The tube 3 is formed by an inner tube 3*a* into which the magnet pieces 4 are inserted and an outer tube 3*b* that covers the inner tube 3*a*. The caps 8 are provided at the both ends of the elongated body 2 so as to close the both ends of the inner tube 3*a* and the outer tube 3*b*. Each of the magnet pieces 4 is formed so as to be rotatable inside the tube 3.

The ornament attachment member 5 is formed by a core body 9 made up of a magnetic material 6, through which the elongated body 2 passes, and an ornament 7 that is integrally formed with the core body 9 so as to surround the core body 9.

In another embodiment, the ornament attachment member 5 is made by forming a magnetic material 6 in a ring shape through which the elongated body 2 passes.

As shown in FIG. 1, from the one end closed by the cap 8, the magnet pieces 4 (4*a*, 4*b*, 4*c*, 4*d*, 4*e*) are arranged in series inside the elongated body 2 of the jewelry piece 1. Each of the magnet pieces 4 (4*a*, 4*b*, 4*c*, 4*d*, 4*e*) is formed in a cylindrical shape. The north pole (N) and the south pole (S) of each of the magnet pieces 4 (4*a*, 4*b*, 4*c*, 4*d*, 4*e*) are arranged opposed with each other on the outer circumferential surface of the cylindrical magnet piece. The north poles and the south poles of the adjacent magnet pieces 4 (4*a*, 4*b*, 4*c*, 4*d*, 4*e*) are arranged in alternate directions. Specifically, the north pole of the magnet piece 4*a*, which is disposed closest to the cap 8 at the one end among the magnet pieces 4, is arranged to be directed downward, and the south pole of the magnet piece 4*a* is directed upward. The north pole of the magnet piece 4*b* that is adjacent to the magnet piece 4*a* and that is the second from the cap 8 is arranged to be directed upward, and the south pole thereof is directed downward. Also, the north pole of the magnet piece 4*c* that is adjacent to the magnet piece 4*b* and that is the third from the cap 8 is arranged to be directed downward, and the south pole thereof is directed upward. Moreover, the north pole of the magnet piece 4*d* that is adjacent to the magnet piece 4*c* and that is the fourth from the cap 8 is arranged to be directed upward, and the south pole thereof is directed downward.

Each of the adjacent magnet pieces 4 (4*a*, 4*b*, 4*c*, 4*d*, 4*e*) is rotatable inside the tube.

The cap 8 at one end is constituted by a disk-shaped cap that has the same diameter as the outer diameter of the tube 3, and a cylindrical insertion part that has the same diameter as the hole diameter of the inner tube 3*a* and that projects from the flat surface of the disk-shaped cap. The cylindrical insertion part of the cap at one end is inserted into the opening at the one end of the elongated body 2, so that the opening at the one end is closed by the cap 8. Similarly, the cap 8 at the other end is constituted by a disk-shaped cap that has the same diameter as the outer diameter of the tube 3, and a cylindrical insertion part that has the same diameter as the hole diameter of the inner tube 3*a* and that projects from the flat surface of the cap 8. The cylindrical insertion part of the cap at the other end is inserted into the opening at the other end of the elongated body 2, so that the opening at the other end is closed by the cap 8.

Permanent magnets used for the magnet pieces 4 include ferrite magnets, samarium-cobalt magnets, and neodymium magnets.

The raw materials of the permanent magnets include iron oxide, cobalt, and nickel. The elements that show ferromagnetism at room temperature by a single substance are limited to these three elements. Samarium and neodymium can be listed as raw materials for magnets, and they do not exhibit ferromagnetism by a single substance, but if they are used as a raw material to produce magnets, the resultant magnets exert strong magnetic force.

Ferrite magnets are made from iron oxide by sintering. The ferrite magnets have the following features. The magnetic flux density is low, but the coercive force is high and demagnetization hardly occurs. The electric resistance is high and eddy current loss is low. They can be applied to devices that generate high frequencies. The hardness is relatively high, and cracking easily occurs. They are strong against chemicals and will not rust because of the properties as ceramics. The ferrite magnets are formed into various shapes by sintering because the original form is powder.

To manufacture the ferrite magnets, the mixture of iron oxide and barium or strontium of a small amount is baked, and is pulverized into particles of about 1 μm. The resultant powder is molded and sintered. Because the ferrite magnets use iron oxide as a main material, they are inexpensively made and chemically stable, whereby they are used for various purposes.

Samarium cobalt magnets are made from samarium and cobalt. There are SmCo 2:17 series magnets and SmCo 1:5 series magnets, which are different in composition ratios. Because SmCo 1:5 series magnets contain a high proportion of expensive samarium, they have become less used since SmCo 2:17 series magnets have appeared. The samarium cobalt magnets are extremely resistant to demagnetization and have good temperature stability (usable up to 200° C.).

Neodymium magnets are the most widely used type of rare-earth magnets, made from an alloy of neodymium, iron, and boron. They have high magnetic flux density and exert strong magnetic force. Because they contain iron and are rusty, plating is usually applied to the surface thereof. Thermal demagnetization is relatively high, and shows about −0.12%/K. Their Curie temperature (the temperature above which the ferromagnetism disappears) is about 310° C. Because of the strong magnetic force exerted by them, they are applied to the drive of a hard disk and CD player, the vibration motor of a mobile phone, and a field magnet of a permanent magnet synchronous motor used for the drive of a train, hybrid car, and elevator.

Figure 2:
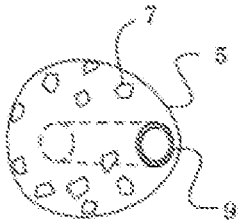
FIG. 2 is a schematic view of the ornament attachment member of the present invention.
Figure 3:
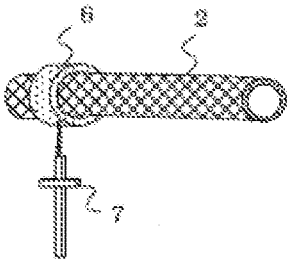
FIG. 3 is a schematic view of another example of the ornament attachment member of the present invention.
Figure 4:
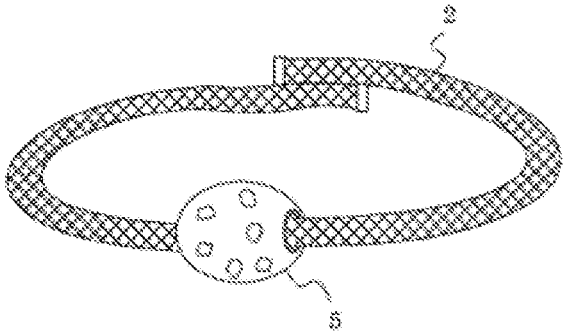
FIG. 4 is an overall view of the jewelry piece of the present invention.

The ornament attachment member 5 made of a circular-shaped magnetic substance as shown in FIGS. 2 and 3 can be attached to any position of the outer periphery of the elongated body of the jewelry piece 1. The ornament attachment member 5 is formed by a core body 9 made of a magnetic material 6, through which the elongated body 2 passes, and an ornament 7 that is integrally formed with the core body 9 so as to surround the core body 9. Because the inner periphery of the ornament attachment member 5 is made of a permanent magnet, the ornament attachment member 5 is strongly attached to the outer periphery of the elongated body of the jewelry piece 1 that is also made of a permanent magnet.

In another embodiment of the ornament attachment member 5, a magnetic material 6 is formed in a ring shape as the ornament attachment member 5, through which the elongated body 2 is inserted, and to which an ornament 7 is attached.

In the ornament attachment member 5 in FIG. 2, an ornament 7 is formed on the outer periphery of the cylindrical core body 9.

In the ornament attachment member 5 in FIG. 3, the magnetic material 6 formed in a ring shape is provided on the outer periphery of the cylindrical elongated body 2. An ornament 7 can be attached to the ornament attachment member 5. This configuration allows for easy replacement of the ornament 7.

Because the elongated body 2 of the present invention is made of a magnetic substance, just overlapping the both ends of the elongated body 2 enables those ends to be joined because of the magnetic force exerted by the elongated body 2, which eliminates the use of a clasp at one end of the elongated body 2, and enhances the easiness of wearing the jewelry piece 1 on a wearer's neck.

Also, the magnetic force exerted by the both ends of the elongated body 2 is set to a level of strength that the joined ends can be separated without applying a strong force, and therefore the jewelry piece 1 worn around the neck can be easily removed.

The jewelry piece 1 of the present invention allows the ornament attachment member 5 to be retained at any position in the longitudinal direction of the elongated body 2, and also makes the ornament 7 to be replaceable with other ornaments.

DESCRIPTION OF REFERENCE SIGNS

1 jewelry piece
2 elongated body
3 tube
3*a* inner tube
3*b* outer tube
4, 4*a*, 4*b*, 4*c*, 4*d*, 4*e* magnet piece
5 ornament attachment member
6 magnetic material
7 ornament
8 cap
9 core body

The invention claimed is:

1. A jewelry piece comprising:

an elongated body comprising a tube that is formed by a flexible material, multiple magnet pieces that are inserted into the tube's inside over its entire length other than both end sections of the tube, and caps that close both ends of the tube, the magnet piece being a ferrite magnet made from iron oxide and barium; and an ornament attachment member that the elongated body passes through, and that is retained due to a magnetic attraction force exerted by the magnet pieces at prescribed positions in the elongated body's longitudinal direction, wherein the ornament attachment member is formed by a core body made of a magnetic material, through which the elongated body passes, and by an ornament that is integrally formed with the core body so as to surround the core body;

wherein the ornament attachment member is made by forming a magnetic material in a ring shape through which the elongated body passes;

wherein each of the magnet pieces is formed so as to be rotatable inside the tube;

wherein the tube comprises an inner tube into which the magnet pieces are inserted, and an outer tube that covers the inner tube; and wherein the caps are attached to the inner tube and the outer tube at the two ends of both of those tubes.

* * * * *